United States Patent [19]

Mills

[11] Patent Number: 4,458,372

[45] Date of Patent: Jul. 10, 1984

[54] CONVERTIBLE DOLL AND SLEEPING BAG

[76] Inventor: Carol B. Mills, 6830 Trexler Rd., Lanham, Md. 20706

[21] Appl. No.: 493,191

[22] Filed: May 10, 1983

[51] Int. Cl.[3] ..... A47G 9/08; A63H 3/00

[52] U.S. Cl. ..... 5/413; 46/151; 2/69.5; 446/72; 446/73

[58] Field of Search ..... 5/413, 419, 420, 417, 5/440; 2/69.5; 224/151, 152, 156; 383/902; 190/2; 46/151, 153, 154

[56] References Cited

U.S. PATENT DOCUMENTS

| | | | |
|---|---|---|---|
| D. 226,101 | 1/1973 | Marcus | 46/153 |
| D. 256,202 | 8/1980 | Schmickel et al. | D6/203 |
| 1,575,263 | 3/1926 | Guglielmi | 5/413 |
| 2,183,418 | 7/1939 | Williams | 5/485 |
| 2,195,127 | 3/1940 | Brucker | 46/153 |
| 2,315,126 | 7/1948 | Parnow | 5/417 |
| 2,655,762 | 10/1953 | Burke | 46/154 |
| 2,678,505 | 5/1954 | Munson | 46/151 |
| 2,791,775 | 4/1955 | Sartell | 2/69.5 |
| 2,971,205 | 2/1961 | Shultz | 5/416 |
| 3,176,315 | 11/1962 | Freund | 5/417 |
| 3,447,165 | 6/1969 | Brosk | 46/154 |
| 3,477,552 | 8/1967 | Goldman | 5/413 |
| 3,774,249 | 11/1973 | Ybarra et al. | 5/419 |
| 3,789,546 | 2/1974 | Morrison | 46/154 |
| 3,851,419 | 12/1974 | Kaelin | 46/153 |
| 3,864,871 | 2/1975 | Kaelin | 46/154 |
| 3,955,309 | 5/1976 | Noble | 46/151 |
| 4,236,263 | 12/1980 | Allee | 5/413 |

*Primary Examiner*—Alexander Grosz
*Assistant Examiner*—Vinh Luong
*Attorney, Agent, or Firm*—Dowell & Dowell

[57] ABSTRACT

A sleeping bag having an image of a doll attached to the upper surface thereof which image includes separate arm and leg appendages which are secured to the upper surfaces of the sleeping bag and a pair of selectively opening panel members which define the body portion of the doll and which are secured to the upper surface of the sleeping bag in such a manner that when such panel members are closed in a first direction they define a pocket in which various articles may be stored when the sleeping bag is in use and when such panel members are moved in an opposite direction the sleeping bag may be folded and received therebetween so that when the panel members are joined to one another such panel members enclose the sleeping bag therein, and thereby form a doll having three-dimensional characteristics. In an alternate embodiment, a portion of the sleeping bag may be selectively stored within the head of the doll when the sleeping bag is not in use.

16 Claims, 13 Drawing Figures

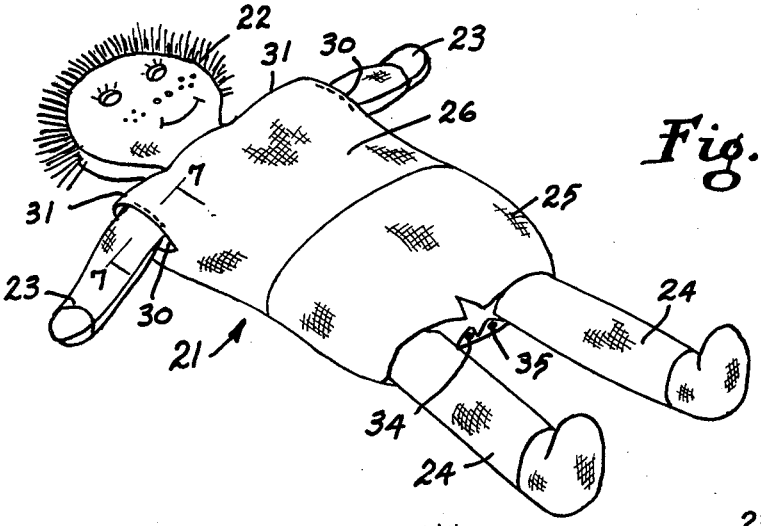
Fig. 1
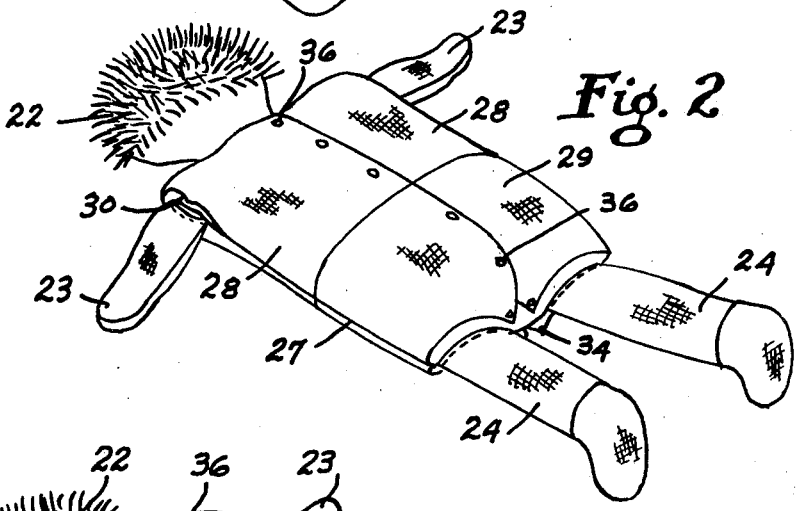
Fig. 2
Fig. 3
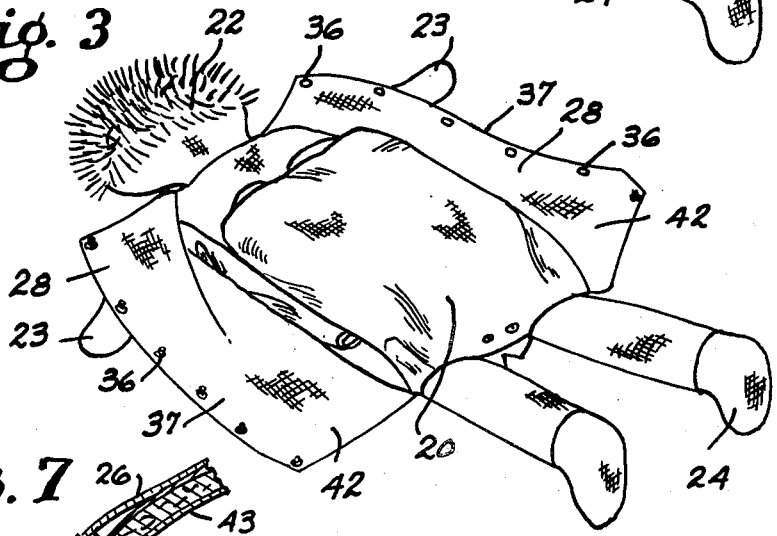
Fig. 7
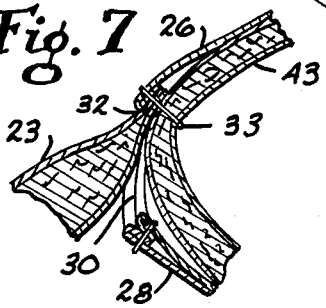

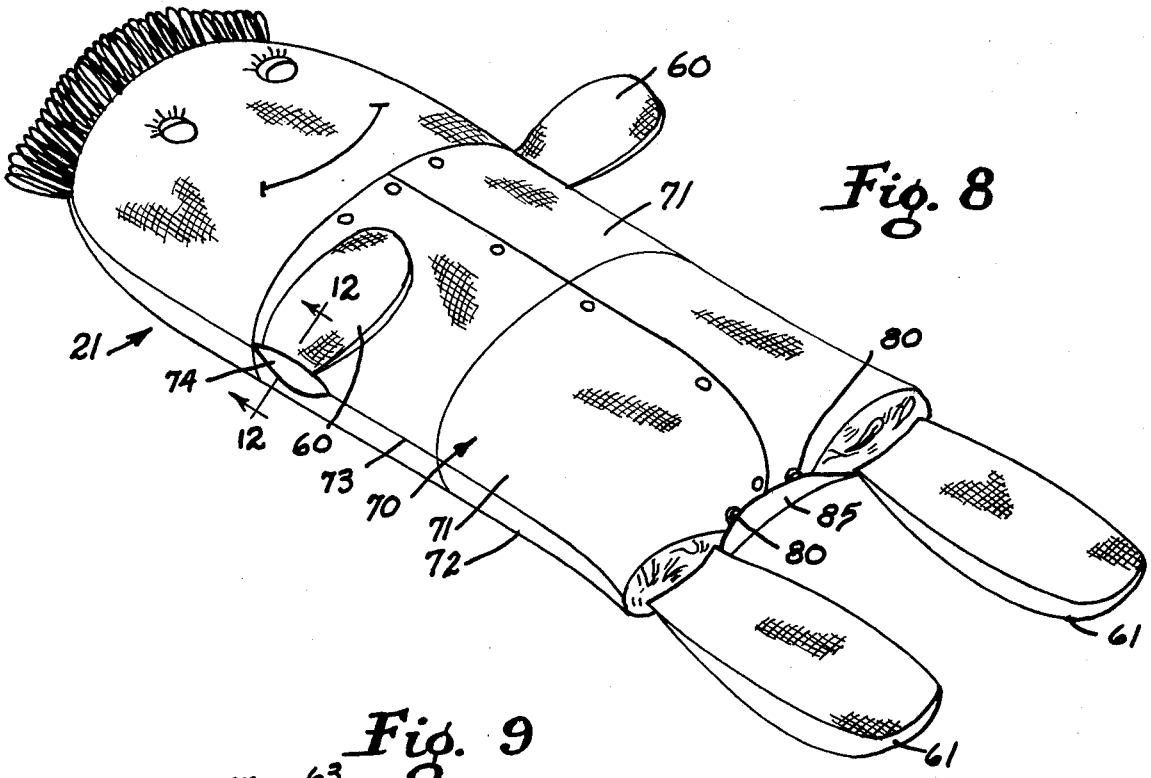
Fig. 8
Fig. 9
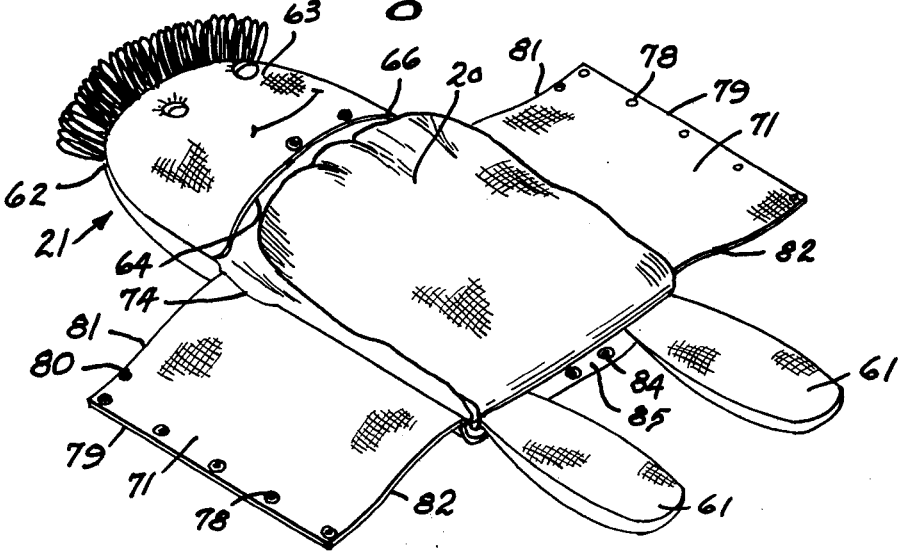
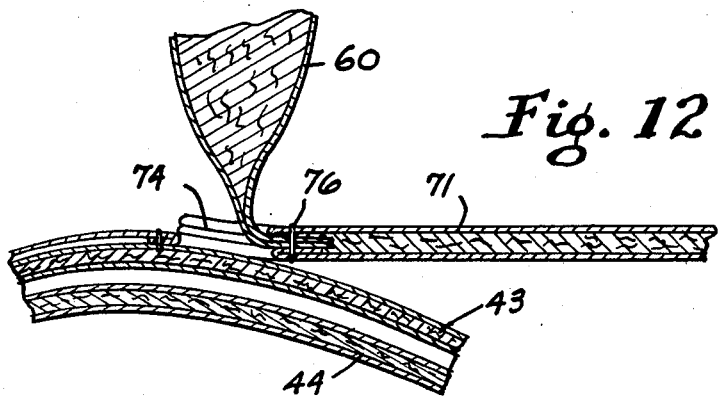
Fig. 12

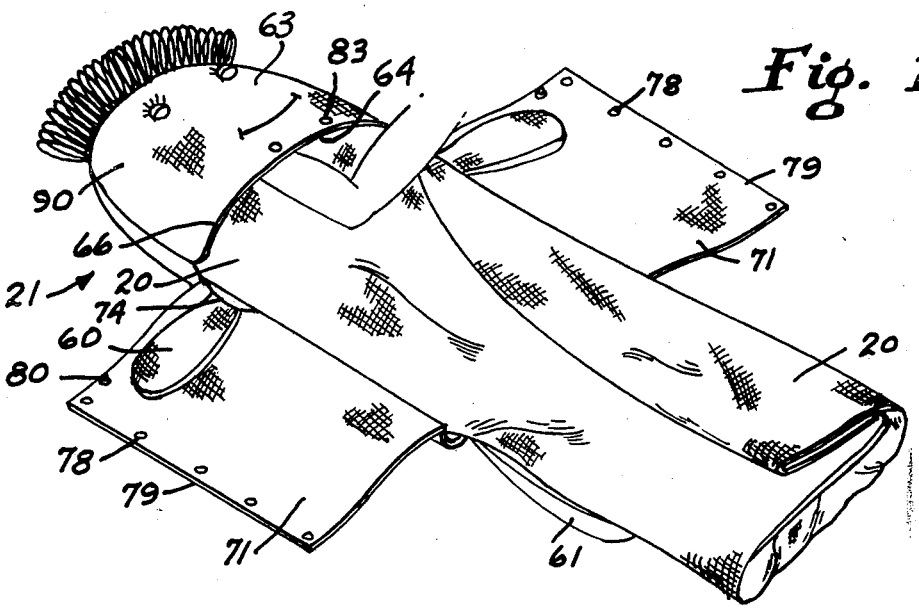
Fig. 10
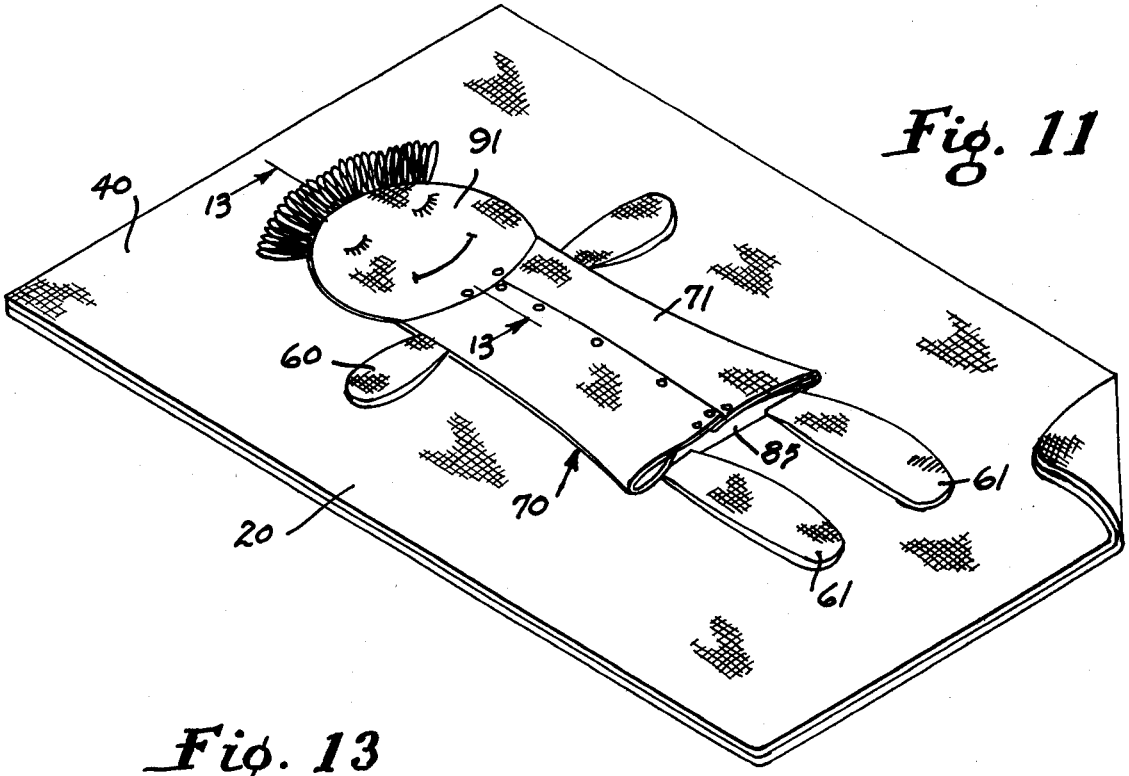
Fig. 11
Fig. 13
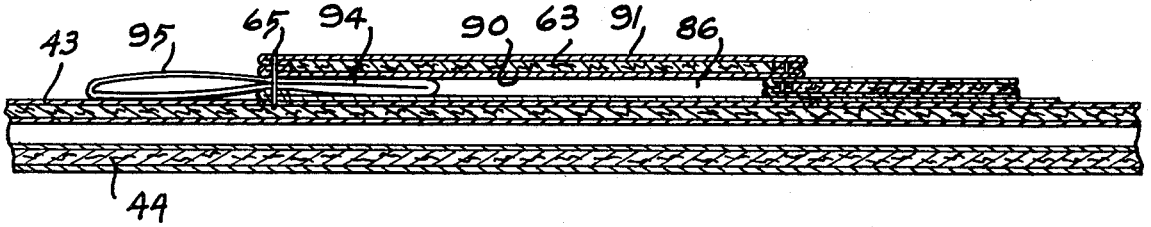

CONVERTIBLE DOLL AND SLEEPING BAG

BACKGROUND OF THE INVENTION

1. Field of the Invention

This invention is generally related to bedding apparatus such as sleeping bags, sleeping blankets, rugs, and the like, and particularly to such bedding apparatus which are convertible to form a three-dimensional doll when folded in a nonuse position.

2. History of the Art

The concept of creating articles of bedding including sleeping bags, lap robes, blankets and the like which may be folded when not in use and stored to create an object having a utility other than that for which it was primarily designed, is generally known in the prior art. In applicant's pending United States patent application, Ser. No. 429,638, filed Sept. 30, 1982, there is disclosed a convertible sleeping bag and stuffed toy which is designed and constructed so as to be especially appealing to children. In such pending application, the sleeping bag includes a shaped pouch or pocket which is attached to the sleeping bag and which selectively receives the sleeping bag therein to form a three-dimensional figure when the sleeping bag is tucked into a nonuse position.

In U.S. Pat. No. 1,575,263 to Guglielmi, there is disclosed a combined coverlet and doll in which the coverlet has a doll attached thereto. When the coverlet is rolled up, it may be selectively secured in a rolled configuration behind the doll. The doll, however, does not receive the remainder of the sleeping bag therein and thus the rolled sleeping bag is always exposed and visibly evident to the observer.

Other prior developments in sleeping bags for children are exemplified by U.S. Pat. Nos. D256,202 to Schmickel et al., and 4,236,263 to Allee. The Schmickel et al. patent discloses a sleeping bag in a configuration of a fish, and the Allee patent discloses a sleeping bag having an image of a creature thereon such as an alligator which is formed on the surface and extends from the sides thereof. Both the foregoing prior art patents do not provide means, however, for receiving the sleeping bag therein in order to create a separate three-dimensional doll or doll-like character when the sleeping bag is not in use.

Other examples of combined or convertible sleeping bags, mats, robes, and the like are disclosed in U.S. Pat. Nos. 2,791,775 to Sartell, and 3,477,552 to Goldman. In each of these patents the robe or mat is selectively folded and received within pocket portions which are attached thereto so that the resulted article resembles a tote bag.

SUMMARY OF THE INVENTION

This application is directed to a convertible sleeping bag and doll wherein portions of a doll image are secured to the surface of a sleeping bag in such a manner that the panels defining the body portions of the doll are selectively opened and closed with respect to the sleeping bag so that when the sleeping bag is not in use it may be selectively folded and retained between such portions of the doll to thereby create or form a threedimensional doll-like configuration. In an alternate embodiment of the invention, the head of the doll also functions as a pocket to receive a portion of the sleeping bag therein when the sleeping bag is folded into a nonuse position.

It is the primary object of this invention to provide a sleeping bag which may be selectively convertible to a three-dimensional doll-like character when folded into a nonuse position.

It is another object of this invention to provide a sleeping bag having an image of a doll attached to the surface thereof. Such doll having a body portion defined by selectively movable panel members which panel members may be selectively opened and closed to house articles such as clothing or toys therein when the sleeping bag is extended into a use position.

It is a further object of this invention to provide a sleeping bag having an image of a doll-like character secured thereto in such a manner that the arm and leg appendages may be freely movable with respect to the sleeping bag when the sleeping bag is in a use position and in which the sleeping bag may be selectively stored within the body portions of the doll when not in use to thereby create a three-dimensional doll-like toy.

It is another object of this invention to provide a sleeping bag which is convertible to a three-dimensional doll so that the sleeping bag has special appeal to children and may be used either as an article of bedding or as a child's toy.

BRIEF DESCRIPTION OF THE DRAWINGS

FIG. 1 is an illustration of one form of the invention in which the sleeping bag has been selectively stored to form a doll-like configuration.

FIG. 2 is an illustration showing the backside of the doll shown in FIG. 1.

FIGS. 3 through 6 are step-by-step illustrations showing the sleeping bag portion of the invention as it is unfolded and extended for use from within the body portion of the doll of FIG. 1.

FIG. 7 is a partial cross-sectional view taken along the lines 7—7 of FIG. 1.

FIG. 8 is an enlarged illustration of a modified form of the invention showing the sleeping bag stored within the body portion of a doll-like character.

FIGS. 9 through 11 are step-by-step illustrations showing the sleeping bag portion of the modified form of the invention shown in FIG. 8 as the sleeping bag is pulled from the head and body portion of the foll into an extended use position.

FIG. 12 is an enlarged partial cross-sectional view taken along the lines of 12—12 of FIG. 8.

FIG. 13 is an enlarged partial cross-sectional view taken along the lines 13—13 of FIG. 11.

DESCRIPTION OF THE PREFERRED EMBODIMENT

Figure 4:
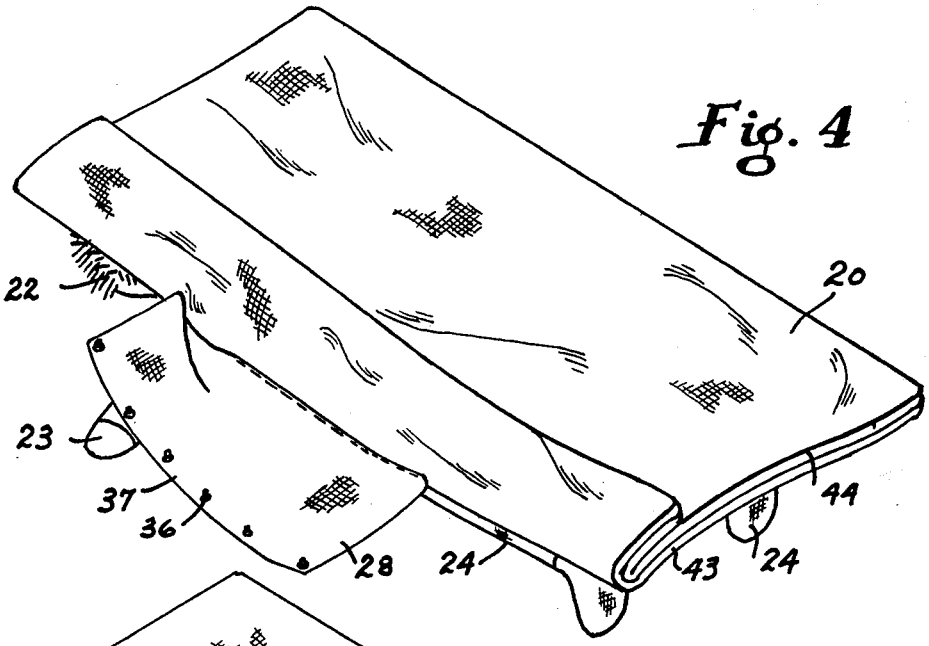

With continued reference to the drawings, a child's sleeping bag or blanket 20 is shown in FIGS. 1 and 2 as it is selectively stored in a nonuse position to form a three-dimensional doll 21. The doll includes a head 22, arms 23, and legs 24, each of which is formed into a three-dimensional configuration by stuffing these members with an appropriate batting or stuffing material such as a polyester batting. The body portion of the doll 25 includes a front body panel 26 which is secured by stitching along the sides of the doll 27 to a pair of movable panel members 28 which define the back 29 of the doll. A pair of oppositely disposed openings 30 are provided between the front and rear panel members adjacent what would be defined as the shoulder areas 31 of the body portion of the doll through which the arms 23 may be selectively extended. As shown in FIG. 7 the arms 23 are secured at their innermost end 32 to the front body panel member 26 by stitching 23.

In order that the panels defining the body of the doll may completely cover and surround the area adjacent the legs, the rear panel portions include flange members 34 which extend between the legs of the doll and which may be selectively secured to the front panel portion 26 by any conventional separable engaging means such as snaps 35.

With particular reference to FIGS. 2 through 6, the technique by which the sleeping bag 20 is unfolded from between the movable panel members 28 is illustrated. The rear movable panel members 28 are selectively joined by any conventional selectively operable securing means such as by use of a plurality of male and female friction snaps generally indicated at 36 which are secured to the outermost edge portions 37 of the panel members. When it is desired to utilize the sleeping bag the snaps 36 are pulled from engagement with one another and the rear body panels 28 are extended outwardly, as shown in FIG. 3, exposing the folded sleeping bag 20. The sleeping bag is subsequently unfolded and extended outwardly relative to the length and width of the doll. The sleeping bag is then inverted so that the upper surface 40 thereof is oriented away from a supporting surface. At this point, the head and legs of the doll will be oriented outwardly with respect to the upper surface 40 of the sleeping bag, however, the arms of the doll remain oriented between the panel members 28 (see FIG. 5). It is, therefore, necessary to extend the arms 23 through the openings 30 between the front and rear panel members so that the arms extend outwardly of the movable panel members. Thereafter the movable panel members are closed relative to one another and secured by the snaps 36. From the foregoing, when the sleeping bag is in a use position, the body portion of the doll is defined by the inner surfaces 42 of the movable rear body panels 28.

Figure 5:
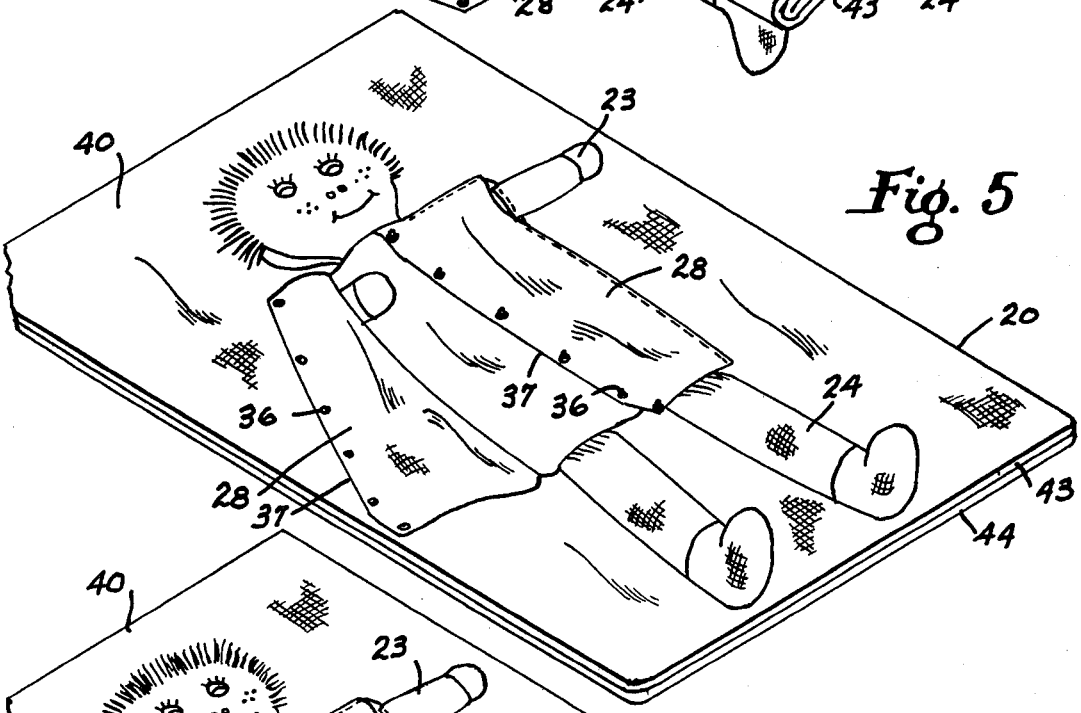
Figure 6:
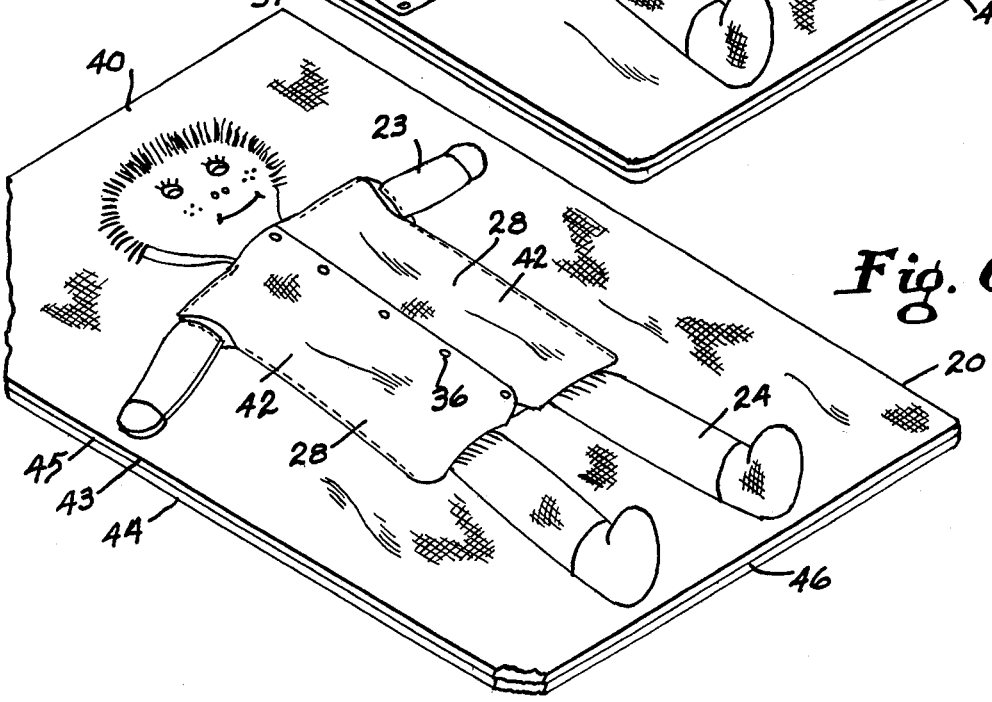

As shown in FIG. 5, the sleeping bag includes upper and lower sections 43 and 44 which are selectively joined along the sides 45 and one end 46 of the sleeping bag by a zipper or other suitable fastening means (not shown). In construction the sleeping bag may be manufactured using a poplin cover material having a lining between which a polyester batting is provided although any other suitable material batting may be used.

In the embodiment of the invention described, and as shown in FIG. 7, the front panel member of the doll 26 is secured by stitching to the upper surface 40 of the upper section 43 of the sleeping bag. The head and legs are likewise secured between the upper surface of the sleeping bag and the body panel 26 by stitching and are, therefore, movable or pivotal with respect to the upper surfaces of the sleeping bag.

Although the length of the sleeping bag is shown as being not too much greater than the height of the doll, the sleeping bag may be made larger. However, the sleeping bag is preferably one of a size which is particularly adapted for young children. Also, although the preferred embodiment of the invention is directed to a doll and sleeping bag combination, it should be noted that the sleeping bag need not be of conventional configuration, but may be in the form of a blanket or sleeping pad, and may be of any desired shape such as rectangular, oblong, or itself simulative of any object, character or other design. In this regard, younger school aged children in nursery or preschool are frequently requested to bring a pad or rug to school for purposes of taking short naps or breaks. The invention is equally applicable to a convertible child's blanket or rug and a doll. In such instances, the sleeping bag would be constructed of a single thickness of material as opposed to the traditional sleeping bag configuration. In addition, the doll could be in the form of a stuffed toy or animal such as a bear or the like.

With specific reference to FIGS. 8 through 13 an alternate embodiment of the invention is disclosed. In the alternate embodiment, the doll 21 includes outwardly extending arms 60 and legs 61 which are filled or stuffed with a conventional batting material. The head 62 is formed having face panel 63 which is joined to the outer surface 40 of the sleeping bag as indicated at 65 by stitching to form a pocket or envelope 64 which is open along the lower edge portion 66 of the face panel 63 and which receives a first portion of the sleeping bag therein as will be more fully described hereinafter.

The body portion of the doll 70 is defined having a pair of front panels 71 which are movable relative to one another and which are connected such as by stitching to a rear panel 72 which forms the back of the body portion of the doll as indicated at 73. An opening 74 is provided between each of the movable panel portions 71 and the rear panel portion 72 in the area adjacent the arms 60 of the doll. When the invention is in a configuration of a doll, the arms 60 are secured to each of the movable panel members 71 by stitching 76 as shown in FIG. 12, and are disposed adjacent each of the openings 74 so as to be forwardly of the openings when viewed from the front of the doll. Also, although the legs 61 are shown as being attached to the upper surface of the sleeping bag, the legs may be selectively attached to the movable panel members 71.

In order to completely enclose the sleeping bag 20 within the doll and to retain the same therein, conventional fastening means such as snaps 78 are disposed along the outermost edge portions 79 of each of the movable panel members 71 with the snap members 78 of each of the panel members 71 being selectively engageable with the opposing snap members of the adjacent panel member 71. Additional fastening means and snap members 80 are provided along the upper and lowermost edges 81 and 82 of each of the panel members 71. The snap members 80 are selectively locked with cooperating snap members 83 and 84 provided adjacent the lower edge 66 of the face panel 63 of the head and a flap portion 85 extending from the rear panel member 72 between the legs 61 of the doll. When the snaps 80 are closed with snaps 83 and 84 the body portion of the doll is closed between the legs of the doll and the head of the doll thereby the doll is a continuous three-dimensional figure.

With particular reference to FIGS. 9 through 11, when it is desired to utilize the sleeping bag 20, the movable panel members 71 are opened relative to one another and a second portion of the sleeping bag is unfolded therefrom outwardly along the length of the doll body. The remainder or first portion of the sleeping bag is then pulled from within the pocket 64 as shown in FIG. 10. As the sleeping bag is pulled from the pocket 64, the pocket will be turned inside out so that the face panel 63 is reversed thereby creating a hollow pocket 86. As the face panel 63 is reversed depending upon whether or not the invention is in the configuration of a doll or sleeping bag, the face panel has first and second facial images 90 and 91 on opposite sides thereof. With reference to FIG. 10, when the invention is in the configuration of a doll, the first facial image is visually displayed and depicts a doll with the eyes opened as if the doll was awake. However, with reference to FIG. 11, when the sleeping bag is in use, the opposite or second facial image is displayed and shows a doll having its eyes closed as if the doll was asleep.

After the sleeping bag has been unfolded and pulled from within the pocket 64, the sleeping bag is inverted or turned over so that the upper surface 40, thereof, is oriented outwardly with respect to the supporting surface. When the sleeping bag is initially inverted, the arms of the doll will be disposed beneath the movable panel members 71. The arms are therefore inserted through the openings 74 between the movable panel member 71 and the rear panel 72. Thereafter, the movable panel members may be snapped or otherwise fastened together. The sleeping bag having a doll image thereon is now ready for use, as shown in FIG. 11. It is apparent that the hollow pocket 86 defined by the head of the doll and the area beneath the movable panel 71 may be selectively used to store a variety of articles including personal items such as brushes, glasses, toothpaste and the like as well as articles of clothing or toys.

In order to give the doll and doll image on the sleeping bag a more realistic look, imitation hair may be secured to the top of the doll's head. With particular reference to FIG. 13, as the head portion of the doll is reversible, that is, capable of being turned inside out, the imitation hair should be secured between the face panel 63 and the upper surface of the sleeping bag so as to extend outwardly from both sides of the seam 65. In this manner, when the invention is in the form of a three-dimensional doll, the hair 94 is visible, while when the face panel is turned inside out as the sleeping bag is extended from the poscket 64, the hair shown as 95 will be visible and the hair 94 will be hidden within the hollow pocket 86. The hair 94 has a utility also in that when it is desired to store the sleeping bag in the pocket 64, the user may grasp the hair and use it as a handle to pull the pocket 86 inside out. As an alternative to the hair shown and described, the doll may have ears, a hat or a separate handle member may be used to provide the same function.

The structure of the sleeping bag shown in the alternate embodiment is similar to that discussed with respect to the previous embodiment. As the invention is particularly suited for children, the size of the sleeping bag, rug or blanket should be appropriately limited.

I claims:

1. A bedding apparatus which is convertible to a doll comprising at least one generally planar cover means having upper and lower surfaces, doll means secured to said upper surface of said cover means, said doll means having head and body portions and first and second three-dimensional arm and leg means which are movably mounted with respect to said cover means, said body portion of said doll means having first and second movable panel members having one edge secured to said upper surface of said cover means so that the opposite edges thereof will be in opposing relationship with one another, securing means disposed along said opposite edges of said panel members for selectively attaching said panel members together, said cover means being foldable both relative forwardly and rearwardly of said doll means, an opening between each of said panel members and said cover means through which said arm means may be selectively extended, said panel members being of a size to extend over and enclose said cover means when said cover means is folded, whereby when said cover means is folded and enclosed within said panel members said cover means functions to stuff the doll means thereby creating a three-dimensional doll.

2. The invention of claim 1 in which said head portion of said doll means is defined as having a face panel which is attached to and spaced from said upper surface of said cover means so as to define a first cavity therebetween which is open adjacent the body portion of said doll means, said face panel having an image bearing surface disposed outwardly relative to said upper surface of said cover means, a second image bearing surface oriented into said cavity, said cavity being of sufficient size to receive a portion of the cover means therein when said face panel is turned inside out, whereby the remainder of said cover means may be folded and received between said movable panel means.

3. The invention of Claim 2 including means for securing the said first and second movable panel members to said head portion of said doll means.

4. The invention of Claim 3 in which said cover means is a sleeping bag having upper and lower insulated sections.

5. The invention of Claim 1 in which said cover means is a sleeping bag having upper and lower insulated sections.

6. The invention of Claim 1 in which said body portion of said doll means includes a fixed panel member attached to the upper surface of said cover means, said movable panel members extending outwardly from either side of said fixed panel member, said fixed panel member forming an outer surface of the doll means when said cover means is enclosed within said body portion of said doll means.

7. The invention of Claim 6 in which said fixed panel member includes a flap portion which extends between the legs of the doll means and means for selectively connecting said flap member to said movable panel members.

8. A three-dimensional doll which is convertible to a bedding apparatus comprising a head portion, a body portion, and first and second arm and leg means attached to said body portion, said body portion of the doll having front and back sections, said front section of said body portion having a front panel means which extends from adjacent said head to said leg means, said back section of said body portion having first and second movable panel means which extend from said front panel means so as to extend behind the doll, fastening means for securing said first and second movable panel means in closed relationship with one another, a cavity defined between said movable panel means and said front panel means, a cover means completely housed within said cavity, said cover means being selectively unfolded from within said cavity whereby when said cover means is not in use said cover means serves as the stuffing for said body portion of the doll.

9. The invention of claim 8 in which said front panel means and said first and second movable panel means are attached to the upper surface of said cover means, an opening between each of said first and second movable panel means and said front panel means, each of said first and second arm means being extendable through one of said openings so that as said movable panel means are moved relative to said cover means said first and second arm means may be selectively reoriented through said openings.

10. The invention of claim 9 including second fastening means for selectively attaching said movable panel means to said head and between said leg means to said front panel means.

11. A three-dimensional doll which is convertible to a bedding apparatus comprising a head portion and a body portion, first and second arm and leg means attached to said body portion, a first pocket means defined within said head portion, said head portion having a facial panel having a first image bearing surface disposed outwardly of the doll, a second image bearing surface oriented into said first pocket means, said body portion of said doll having a fixed panel member and first and second movable panel members, said fixed panel member being disposed between said first and second movable panel members, means for selectively attaching said movable panel members in generally opposing relationship with one another to form a second pocket means between said first and second movable panel members and said fixed panel member, a cover means, a first portion of said cover means being retained within said first pocket means and a second portion of said cover means being retained within said second pocket means, said first and second portions of said cover means being selectively removed from said body portion of the doll when said movable panel members are opened with respect to one another, said second portion of said cover means may be unfolded with respect to said body portion of the doll and said head portion may be turned inside out thereby removing said first portion of said cover means therefrom.

12. The invention of claim 11 including an opening between each of said movable panel members and said fixed panel member through which said first and second arm means may be selectively extended.

13. The invention of claim 12 including means for fastening said panel members to said head portion and between said first and second leg means to said fixed panel member.

14. A bedding apparatus convertible to a stuffed doll comprising a sleeping bag means having upper and lower surfaces, doll means attached to the upper surface of said sleeping bag means, said doll means including a head and body portions and movable first and second arm and leg means, said arm and leg means attached to and extending from said body portion of said doll means, said body portion having movable panel means attached to said upper surface of said sleeping bag, said sleeping bag being selectively receivable within said movable panel means of said body portion to thereby form the stuffing for the body portion of said doll means.

15. The invention of claim 14 in which said head portion of said doll means forms a pocket which is attached to the upper surface of said sleeping bag means and said pocket defines a cavity in which a portion of said sleeping bag means is selectively retained when said pocket is turned inside out.

16. The invention of claim 14 in which said movable panel means includes first and second opposing panel members, each of said opposing panel members having inner and outer edge portions, said outer edge portions being secured to said upper surface of said sleeping bag means, and means for selectively retaining said inner edge portion of said opposing panel members in joined relationship with one another.

* * * * *